US008240175B2

(12) United States Patent
Kim et al.

(10) Patent No.: US 8,240,175 B2
(45) Date of Patent: Aug. 14, 2012

(54) DRUM TYPE WASHING MACHINE

(75) Inventors: Myung Shik Kim, Gyeongsangnam-do (KR); Ho Il Jeon, Gyeongsangnam-do (KR); Jong Hee Han, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 797 days.

(21) Appl. No.: 12/400,612

(22) Filed: Mar. 9, 2009

(65) Prior Publication Data

US 2009/0223256 A1 Sep. 10, 2009

(30) Foreign Application Priority Data

Mar. 10, 2008 (KR) ..... 10-2008-0022044

(51) Int. Cl.
*D06F 33/00* (2006.01)
*D06F 39/00* (2006.01)

(52) U.S. Cl. ..... 68/3 R; 68/12.23; 68/12.27; 312/228.1

(58) Field of Classification Search ..... 68/3 R, 68/12.01, 12.23, 12.27; 312/228, 228.1
See application file for complete search history.

(56) References Cited

U.S. PATENT DOCUMENTS

| | | | | |
|---|---|---|---|---|
| 7,395,683 | B2 * | 7/2008 | Kim et al. | 68/12.27 |
| 2005/0178164 | A1 * | 8/2005 | Kim et al. | 68/3 R |
| 2005/0183469 | A1 * | 8/2005 | Kang | 68/3 R |
| 2005/0183471 | A1 * | 8/2005 | Kang et al. | 68/12.27 |
| 2005/0210926 | A1 * | 9/2005 | Kwon et al. | 68/3 R |
| 2006/0199461 | A1 * | 9/2006 | Yamazaki et al. | 445/24 |
| 2006/0225302 | A1 * | 10/2006 | Lyu et al. | 34/595 |
| 2007/0180867 | A1 * | 8/2007 | Hur | 68/3 R |
| 2007/0209227 | A1 | 9/2007 | Park | |
| 2008/0053159 | A1 | 3/2008 | Hwang et al. | |
| 2008/0155761 | A1 * | 7/2008 | Hoppe et al. | 8/159 |
| 2008/0229789 | A1 * | 9/2008 | Kim et al. | 68/12.01 |

FOREIGN PATENT DOCUMENTS

WO WO 2007/104433 A1 9/2007

* cited by examiner

*Primary Examiner* — Joseph L Perrin
(74) *Attorney, Agent, or Firm* — Birch, Stewart, Kolasch & Birch, LLP

(57) ABSTRACT

A drum type washing machine having a control panel assembly which can make, not only an exterior of the drum type washing machine beautiful, but also enable the user to operate the drum type washing machine easily is provided. The drum type washing machine includes a body which forms an exterior of the drum type washing machine, a front plate secured to a front of the body, having a door mounted thereto, and a touch switch mounted to the front plate for applying a washing course.

4 Claims, 4 Drawing Sheets

[FIG. 1]
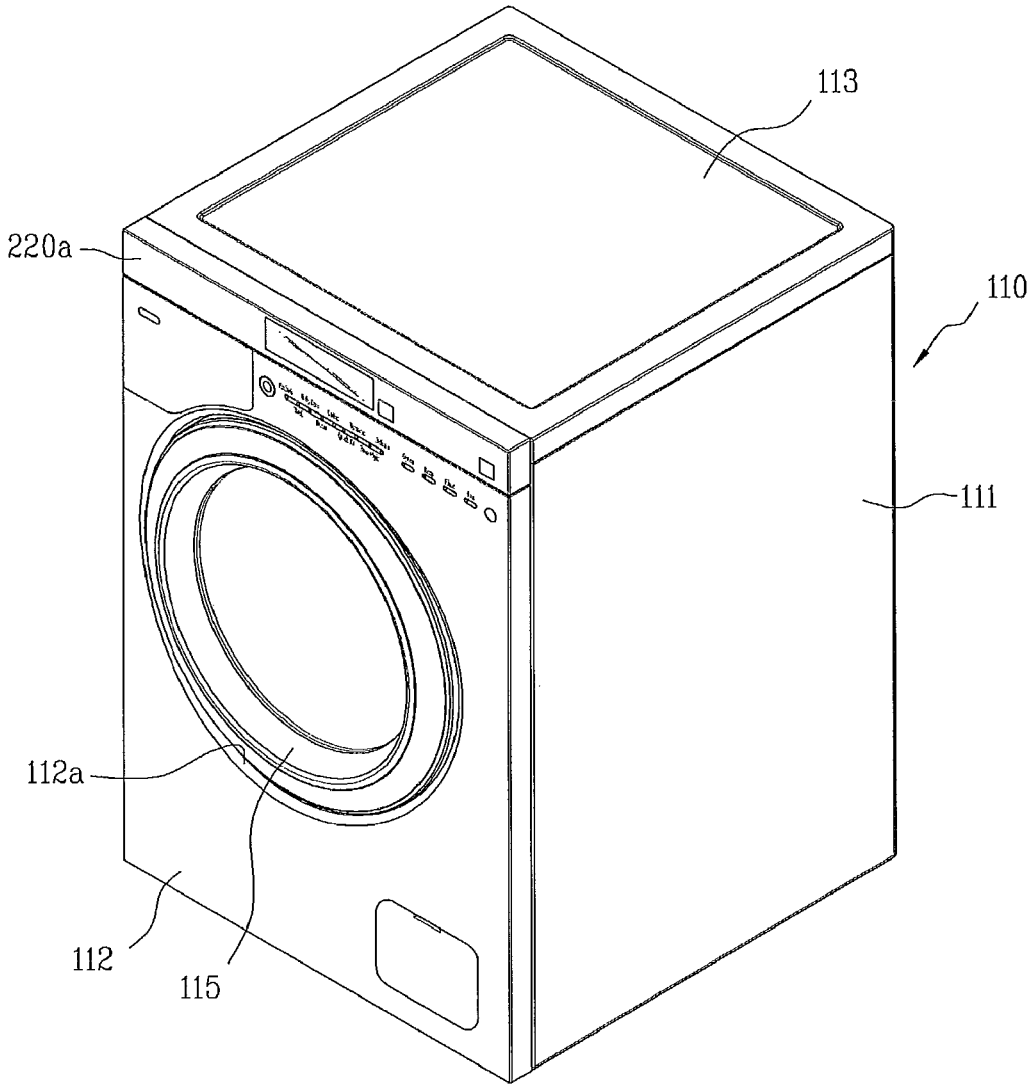

[FIG. 2]
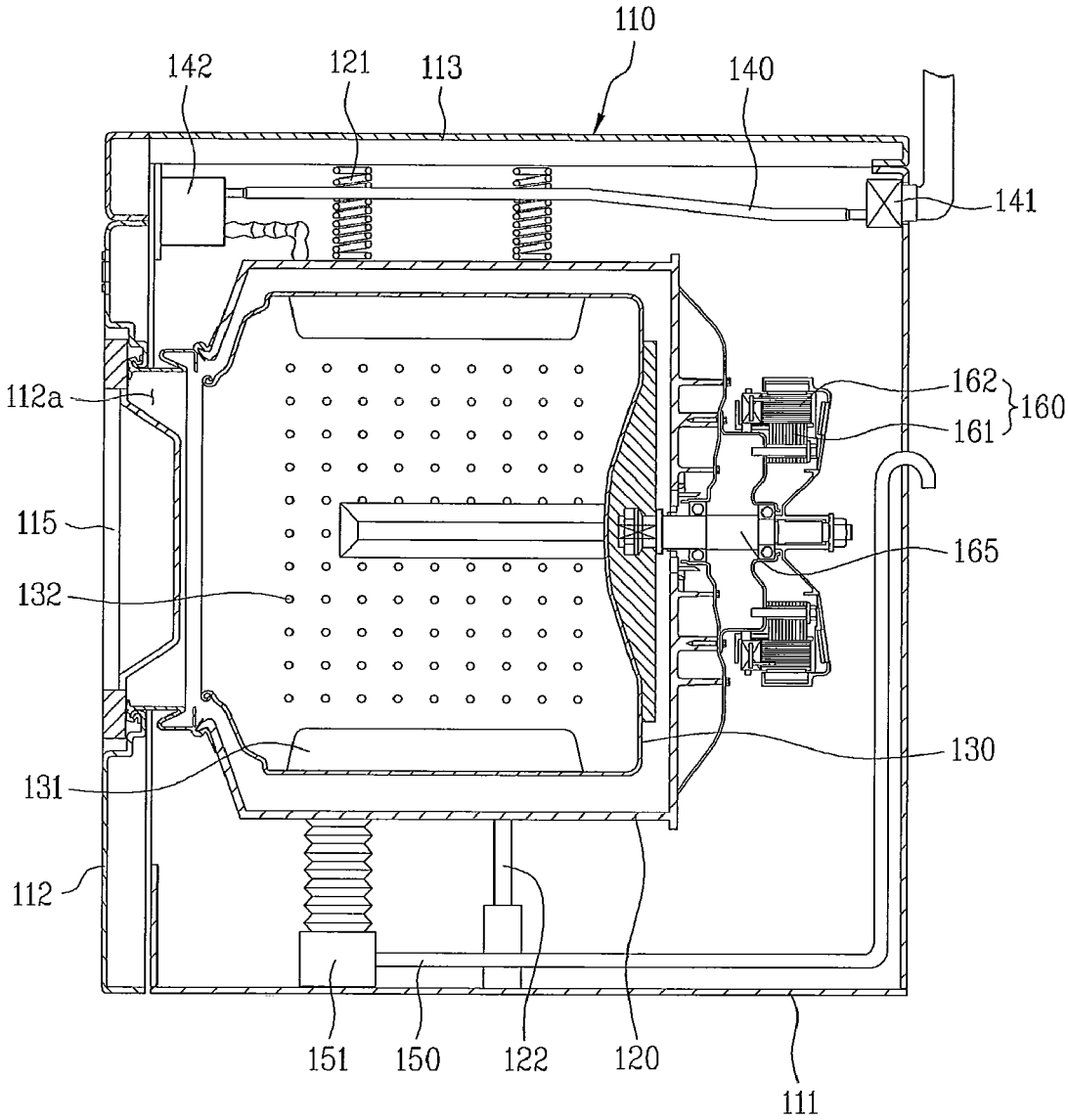

[FIG. 3]
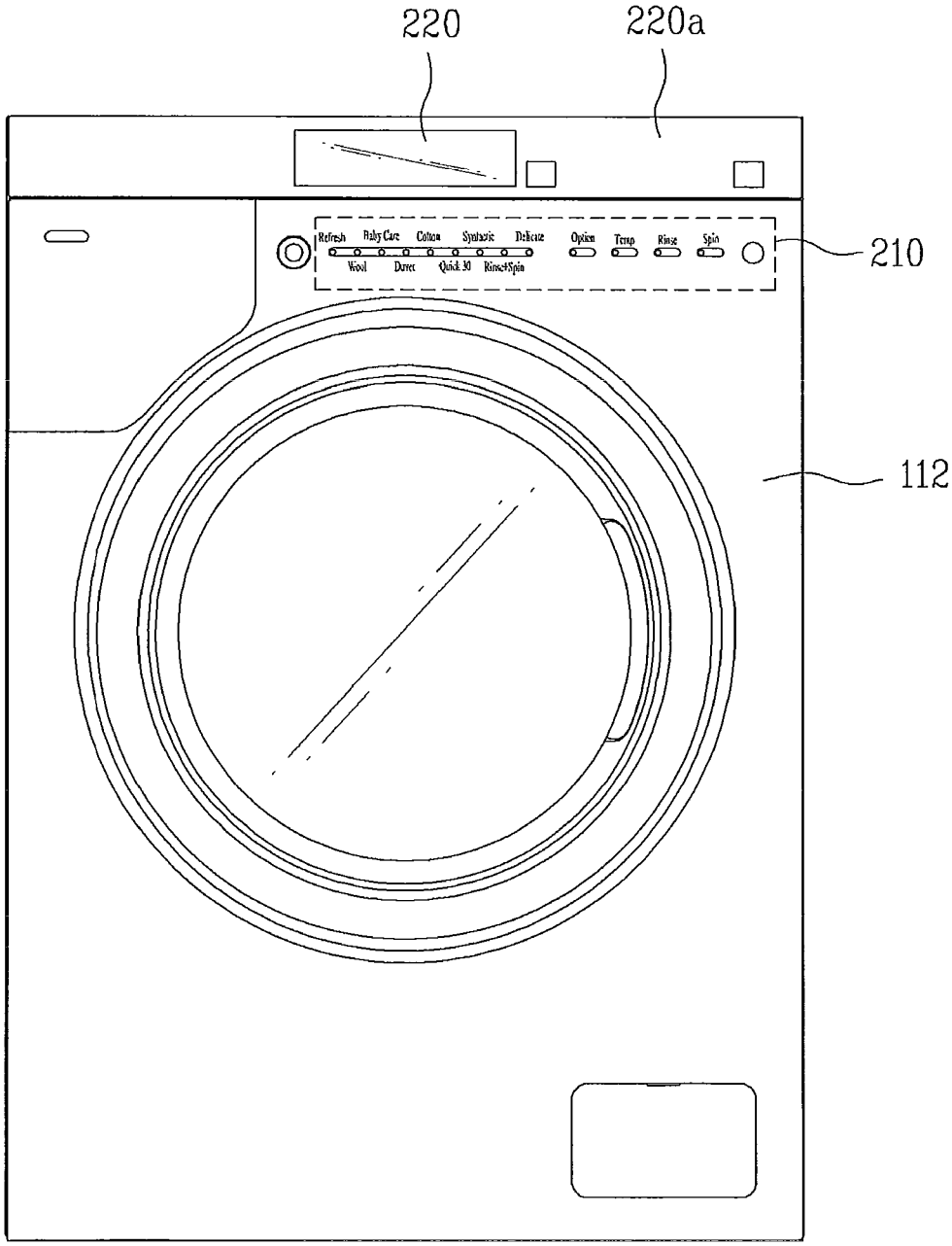

[FIG. 4]
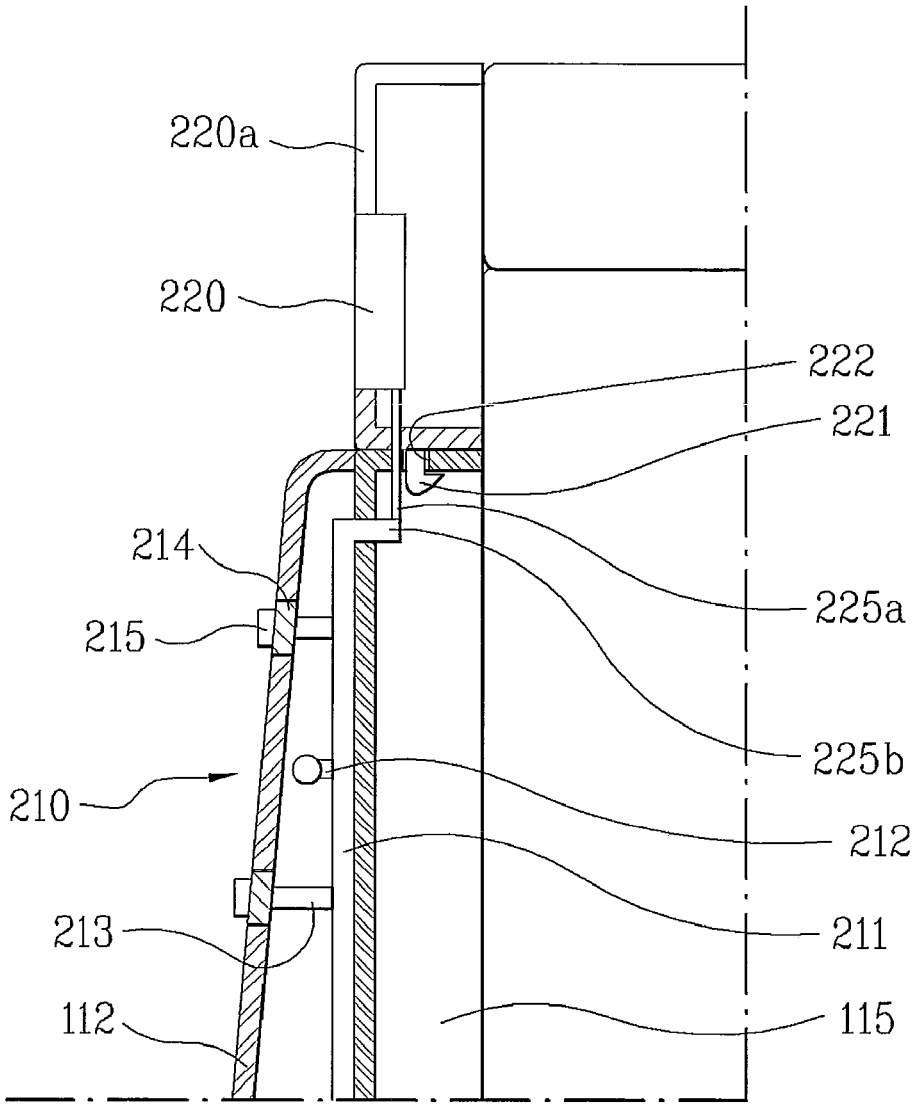

DRUM TYPE WASHING MACHINE

CROSS REFERENCE TO RELATED APPLICATION

This application claims the benefit of the Patent Korean Application No. 10-2008-0022044, filed on Mar. 10, 2008, which is hereby incorporated by reference as if fully set forth herein.

BACKGROUND OF THE DISCLOSURE

1. Field of the Disclosure

The present invention relates to a drum type washing machine having an operation unit and a display unit provided, separately.

2. Discussion of the Related Art

In general, the drum type washing machine is a home appliance which, after the laundry is introduced to a drum and supplying detergent and washing water to a tub, makes laundry washed in a friction process between washing water held in the tub and the laundry in the drum which is rotated as a motor is driven. The drum type washing machine is advantageous in that almost no laundry damage takes place, and the laundry does not entangle.

The drum type washing machine is provided with a cabinet which forms an exterior thereof, and a control panel mounted to an upper side of a front of the cabinet.

The control panel is provided with the operation unit for enabling a user to select a washing course, and the display unit for displaying the washing course the drum type washing machine.

The operation unit is provided with a rotary switch and a plurality of buttons, for enabling the user to select and apply the washing course.

The display unit displays information selected or applied at the operation unit, or progress of the washing course.

In the meantime, the rotary switch and the button of the operation unit and the display unit are secured to one printed circuit board (PCB) and mounted to the control panel.

Consequently, even if only a portion of the operation unit and the display unit is out of order, it is required to remove an entire control panel for repair.

Moreover, the mounting of the operation unit and the display unit on the front panel together harms beauty of an exterior of the drum type washing machine.

Moreover, since a color of the drum type washing machine can not be changed, meeting various users' demands on visual sensation is failed.

SUMMARY OF THE DISCLOSURE

Accordingly, the present invention is directed to a drum type washing machine.

An object of the present invention is to provide a drum type washing machine which enables, if a component of the control panel is out of order, removal of only the component being out of order from the control panel for repair.

Another object of the present invention is to provide a drum type washing machine which can make an exterior of the drum type washing machine beautiful.

Another object of the present invention is to provide a drum type washing machine which enables to meet various users' demands on visual sensation.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type washing machine includes a cabinet, a front panel secured to a front of the cabinet, an operation unit mounted to the front panel for selection of a washing course, and a display unit mounted to the front of the cabinet separate from the front panel for displaying the washing course received at the operation unit.

The drum type washing machine further includes a display unit panel mounted to an upper side of the front panel secured to the cabinet, the display unit panel having the display unit provided thereto.

The drum type washing machine further includes an insertion panel provided between the front panel and the cabinet.

The display unit panel is detachably mounted to the insertion panel.

The insertion panel has a color different from the front panel.

The display unit panel includes a hook to be placed in the insertion panel, and the insertion panel includes a hook hole for receiving the hook.

The drum type washing machine as further includes a control unit mounted on a back side of the front panel for controlling the drum type washing machine according to a washing course received from the operation unit, and the display unit further includes a connector for connection to the control unit.

The control unit and the display unit are connected once the display unit panel and the front panel are joined together, and the control unit and the display unit are disconnected once the display unit panel is separated from the front panel.

The display unit is constructed of organic EL (Organic Light Emitting Diodes).

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 1 illustrates a perspective view of a drum type washing machine in accordance with a preferred embodiment of the present invention.

FIG. 2 illustrates a section of the drum type washing machine in FIG. 1.

FIG. 3 illustrates a front view of the drum type washing machine in FIG. 1.

FIG. 4 illustrates a section of a portion of a control panel in accordance with a preferred embodiment of the present invention.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

FIG. 1 illustrates a perspective view of a drum type washing machine in accordance with a preferred embodiment of the present invention, and FIG. 2 illustrates a section of a drum type washing machine in FIG. 1.

Referring to FIGS. 1 and 2, the drum type washing machine includes a cabinet 110 which forms an exterior of the drum type washing machine, a tub 120 (See FIG. 2) in the cabinet 110 for holding washing water, a drum 130 (See FIG. 2) rotatably mounted in the tub 120, and a motor 160 (See FIG. 2) for driving the drum 130.

The cabinet 110 includes a body 111 which forms sides, rear and bottom of the drum type washing machine, a front plate 112 which forms a front of the cabinet 110, and a top plate 113 joined to a top of the body 111 to form a top of the cabinet.

The front plate 112 which forms a front of the cabinet 110 has a laundry opening 112*a* formed therein for introduction of laundry, opened/closed by a door 114 rotatably mounted to the cabinet 110.

It is preferable that the front panel 112 has a thickness which becomes the thinner as the front panel goes from a lower side to an upper side the more.

If the front panel 112 has a thickness which becomes the thinner as the front panel goes from a lower side to an upper side the more, the user feels a sense of security, and the exterior of the drum type washing machine becomes beautiful.

Referring to FIG. 2, the tub 120 is positioned in the cabinet by hanging springs 121 and dampers 122 for holding the washing water.

The hanging spring 121 has one side connected to the top plate 133, and the other side connected to a top side of the tub.

In the meantime, the damper 122 under the tub 120 attenuates vibration generated at the time the drum rotates at a high speed.

The drum 130 has lifters 131 on an inside circumferential surface for lifting the laundry in the drum 130 to a predetermined height.

The drum 130 also has a plurality of pass through holes 132 in an inside circumferential surface for discharging the washing water from the laundry to the tub 120 in a process of a washing course, such as spinning.

On an upper side of the tub 120, there is a water supply hose 140 for supplying water to the tub 120 from an outside of the cabinet.

The water supply hose 140 may include a water supply valve 141 for controlling water supply, and a detergent supply device 142 for making the water supplied through the water supply hose 140 to be introduced into the tub 120 together with the detergent.

In the meantime, it is preferable that a drain hose 150 and a drain pump 151 are provided on a lower side of the tub 120 for draining the water used for the washing course to an outside of the washing machine.

On a rear of the tub 120, there is the motor 160 for rotating the drum, including a rotation shaft 165 passed through the rear of the tub 120.

The motor 160 includes a stator 161 fixedly secured to the rear of the tub 120, and a rotor 162 rotated by electro-magnetic interaction with the stator 161.

FIG. 3 illustrates a front view of the drum type washing machine in FIG. 1.

Referring to FIG. 3, the cabinet 110 has the front panel 112 and a display unit panel 220*a* on the front of the cabinet 110.

The display unit panel 220*a* is positioned on an upper side of the front panel 112 having a display unit 220 to be described later secured thereto.

Mounted to an upper side of the front of the cabinet, there is a control panel for enabling the user to select and apply a washing course to the drum type washing machine.

It is preferable that the control panel includes an operation unit 210 and a display unit 220 separated from each other.

Therefore, the operation unit 210 may be mounted to the front panel 112 and the display unit 220 may be mounted to the display unit panel 220*a*.

Since the operation unit and the display unit are mounted separate from each other, if either one of the operation unit and the display unit is out of order, only the unit being out of order can be removed from the cabinet for repair.

FIG. 4 illustrates a section of a portion of a control panel in accordance with a preferred embodiment of the present invention.

The operation unit 210, the display unit 220 and an insertion panel 115 of the drum type washing machine of the present invention will be described with reference to FIG. 4.

It is preferable that the operation unit 210 includes a control unit for controlling the drum type washing machine following the washing course the user applies, and a light emitting unit secured to the control unit for emitting a light.

The control unit may be, for an example, a PCB 211 having various kinds of circuit components mounted thereto, and the light emitting unit may be an LED.

In the meantime, the PCB 211 is mounted to a back side of the front panel, and the LED 212 is secured to the PCB 211.

The PCB 211 has an LED supporter 213 for supporting the LED 212, and, secured to a front of the LED supporter 213, there is a touch panel 214 having various kinds of operation buttons 215 mounted thereto.

The touch panel 214 is passed through an opening in the front panel 112 and exposed to the front of the drum type washing machine.

The touch panel 214 has a plurality of the operation buttons 215 for the user to select the washing course of the drum type washing machine.

It is preferable that the operation button 215 is of a touch pad type which receives a signal the user applies thereto by sensing a pressure of user's finger pressing down the touch pad or sensing a contact of user's finger.

In the meantime, the LED 212, secured to the PCB 211, emits the light if the user presses down the operation button 215 so that the user can recognize the washing course the user selects by means of the operation button.

Accordingly, the user can recognize the washing course the user selects by means of the operation button, easily.

If the user applies the washing course by operating the operation button 215, the washing course selected thus is displayed on the display unit 220.

It is preferable that the display unit 220 is constructed of organic EL (Organic Light Emitting Diodes).

The display unit 220 constructed of a display panel of organic EL makes an exterior of the display unit 220 beautiful, and enables to reduce power consumption.

In the meantime, referring to FIG. 3, the display unit panel 220*a* has a width the same with a width of the front panel 112 and is mounted to an upper side of the front panel 112.

The inserting panel 115 may be mounted between the front panel 112 and the body 111 of the cabinet.

In this case, it is preferable that the insertion panel 115 has a size identical to the front panel 112, and the display unit panel 220*a* has a securing means for detachably mounting the display unit panel 220*a* to an upper side of the insertion panel 115.

The securing means may be a hook and a hook hole for detachably mounting the display unit panel 220*a* to the insertion panel 115.

Accordingly, one of the insertion panel 115 and the display unit panel 220*a* may have the hook 221, and the other one may have the hook hole 222.

Though the embodiment disclosed in FIG. 4 illustrates the hook 221 on the display unit panel 220*a* and the hook hole 222 in the insertion panel 115, the hook 221 may be on the insertion panel 115 and the hook hole 222 may be in the display unit panel 220*a*.

Or, the display unit panel 220*a* may be fastened to the insertion panel 115 or the body 111 with screws.

Since the display unit panel 220*a* can be detachably mounted to the insertion panel 115 easily, if either one of the display unit and the operation unit is out of order, only the unit being out of order can be removed for repair.

In the meantime, since the display unit 220 mounted to the display unit panel is separate from the PCB 211 which serves as a control unit, it is preferable that means for connecting the display unit to the PCB is provided.

According to this, the drum type washing machine of the present invention includes a display unit connector 225*a* projected from the back side of the display unit 220 toward the PCB 211, and a PCB connector 225*b* projected from the back side of the PCB 211 toward the display unit 220.

It is preferable that the connectors are devised such that the connectors are connected to each other once the display unit panel 220*a* and the insertion panel 115 are joined together, and the connectors are separated from each other once the display unit panel 220*a* and the insertion panel 115 are separated from each other. A jack connector may be one example of the connectors.

The connectors may be of a harness type.

It is preferable that the insertion panel 115 has a color different from the front panel 112.

There may be a plurality of the display unit panels 220*a* having colors, preferably, different from one another.

For an example, the display unit panels 220*a* may have black, red, blue and green colors.

Accordingly, if the user is bored by the exterior of the drum type washing machine, or the color of the drum type washing machine does not match with the place the drum type washing machine is installed, the display unit panel 220*a* may be replaced with one having a color matched to the place whenever required.

By this, the exterior of the drum type washing machine can be made beautiful, and the various users' demands on visual sensation can be met.

As has been described, the drum type washing machine of the present invention has the following advantages.

The display unit panel 220*a* can be detachably mounted to the insertion panel 115, and there may be a plurality of the display unit panels 220*a*, enabling to have colors different from one another.

Therefore, since the user can replace the display unit panel 220*a* with one having a different color easily, the various users' demands on visual sensation can be met.

The operation unit 210 and the display unit 220 provided separate from each other is favorable for maintenance of the drum type washing machine, because, even if either one of the operation unit 210 and the display unit 220 is out of order, only the unit out of order can be removed for repair.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum type washing machine comprising:

a cabinet;

an insertion panel secured to a front of the cabinet;

a front panel secured to a front of the insertion panel;

an operation unit mounted to the front panel for selection of a washing course;

a control unit mounted on a back side of the front panel for controlling the drum type washing machine according to a washing course received from the operation unit;

a display unit panel positioned on an upper side of the front panel; and a display unit mounted to the display unit panel for displaying the washing course received at the operation unit, wherein the display unit panel is detachably mounted to the insertion panel, the display unit includes a display unit connector projected from the back side of the display unit toward the control unit, the control unit includes a control connector projected from the back side of the control unit toward the display unit, the display unit connector and the control connector are connected once the display unit panel and the insertion panel are joined together, and the display unit connector and the control connector are disconnected once the display unit panel is separated from the insertion panel.

2. The drum type washing machine as claimed in claim 1, wherein the insertion panel has a color different from the front panel.

3. The drum type washing machine as claimed in claim 1, wherein the display unit panel includes a hook to be placed in the insertion panel, and the insertion panel includes a hook hole for receiving the hook.

4. The drum type washing machine as claimed in claim 1, wherein the display unit is constructed of organic EL (Organic Light Emitting Diodes).

* * * * *